US006302732B1

(12) United States Patent
Budman et al.

(10) Patent No.: US 6,302,732 B1
(45) Date of Patent: Oct. 16, 2001

(54) COAXIAL CONNECTION APPARATUS AND METHOD OF ATTACHMENT

(75) Inventors: Mark Budman, Vestal; Mario J. Interrante, New Paltz; John U. Knickerbocker, Hopewell Junction, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/460,888

(22) Filed: Dec. 14, 1999

(51) Int. Cl.[7] ..... H01R 9/05
(52) U.S. Cl. ..... 439/581
(58) Field of Search ..... 439/625, 278, 439/578, 736, 92, 607, 610, 63, 668, 669

(56) References Cited

U.S. PATENT DOCUMENTS

| | | | |
|---|---|---|---|
| 5,122,065 | 6/1992 | Dudek et al. | 439/76 |
| 5,308,250 | 5/1994 | Walz | 439/63 |
| 5,516,294 | 5/1996 | Andrews et al. | 439/63 |
| 5,797,765 | 8/1998 | Barnett et al. | 439/63 |
| 5,823,790 | 10/1998 | Magnuson | 439/63 |
| 5,842,881 | 12/1998 | Ecker et al. | 439/329 |
| 5,872,334 * | 2/1999 | Trazyik | 174/36 |
| 5,940,966 | 8/1999 | Fasano et al. | 29/842 |
| 6,053,769 * | 4/2000 | Kubato et al. | 439/578 |

FOREIGN PATENT DOCUMENTS 7-176231 * 7/1995 (JP) .

* cited by examiner

*Primary Examiner*—Paula Bradley
*Assistant Examiner*—Shanetta D. Ore
(74) *Attorney, Agent, or Firm*—Margaret A. Pepper; John Jordan

(57) ABSTRACT

A coaxial connector having a conductive copper wire core plated with a layer of gold with the layer of gold surrounded by a dielectric layer, such as polyimide. The layer of polyimide is surrounded by a conductive shielding layer, such as copper, with a tin-plated layer surrounding it. Connection of the coaxial connector at one end to adjacent signal and ground pads is achieved by laser ablation to expose a section of gold sufficient to accommodate the terminal pad pitch and allow wire bonding to the signal pad. Connection of the conductive shielding layer to the ground pad is achieved by hot tip soldering. Connection at the opposite end of the coaxial connector uses the same process.

15 Claims, 2 Drawing Sheets

COAXIAL CONNECTION APPARATUS AND METHOD OF ATTACHMENT

BACKGROUND OF THE INVENTION

1. Field of the Invention

The present invention relates to coaxial connection apparatus and method for its attachment to electronic devices. More particularly, the present invention relates to a coaxial-type wire bond connector structure and method for its attachment, for example, at one end to a chip die and the other end to some form of laminate.

2. Background and Related Art

In the fabrication of electronic devices, not only is there a trend toward higher density input/output (I/O) but also a trend toward more use of high frequency applications, such as RF communications. As a result of these trends, noise coupling becomes more of a problem, particularly in communicating high frequency signals between devices.

One of the difficulties of prior attempts to reduce noise coupling between devices resides in the design of the coaxial connectors used to interconnect the devices. Most coaxial designs are directed to single connection applications used for testing purposes. Typically, such connectors are relatively large in size and often are designed to mechanically attach at the connection points. Overall, such designs can result in a degree of unshielded coaxial wire that permits undesirable noise coupling between devices. In addition, the size of such connectors utilizes valuable I/O area and, in some instances, utilizes additional height dimension for the device packages.

Accordingly, it is an object of the present invention to provide improved connecting means and method for making attachment to terminal pads of high density input/output electronic devices.

It is a further object of the present invention to provide an improved coaxial connecting apparatus and method effective for making multiple connections in interconnecting electronic devices.

It is yet a further object of the present invention to provide improved coaxial connecting apparatus and method for simply making high density multiple connections between high frequency electronic devices.

It is another object of the present invention to provide an improved coaxial cable and method for connecting a plurality of said cables to reduce noise coupling in high frequency device applications.

It is yet another object of the present invention to provide a coaxial cable and method for connecting same that reduces the amount of unshielded wire in the interconnection of high frequency devices.

It is yet a further object of the present invention to provide a coaxial wire cable capable of wire bonding to signal pads for interconnection of high frequency devices.

SUMMARY OF THE INVENTION

In accordance with one aspect of the present invention, a coaxial connector is provided having a conductive wire core plated with a layer of gold. The layer of gold is surrounded by a dielectric layer which, in turn, is surrounded by a shielding layer of conductive material, such as copper or nickel, having an immersion tin plated deposit surrounding it. For some applications, a second dielectric layer is used to surround the shielding layer.

In accordance with another aspect of the invention, the coaxial connector is employed for electronic device interconnection with minimal unshielded wire and effective for making multiple high density connections. A laser ablation process is used to remove both the shielding material and the dielectric sufficient to accommodate the particular terminal pad pitch. A conventional wire bonding process is then used to bond the gold plated wire core to the device signal pad. A hot tip solder step is then used to solder the tin-plated shielding layer to a corresponding solder coated ground pad. Similar steps are used to connect the other end of the coaxial connector to another electronic device or laminate.

DETAILED DESCRIPTION

Figure 1:
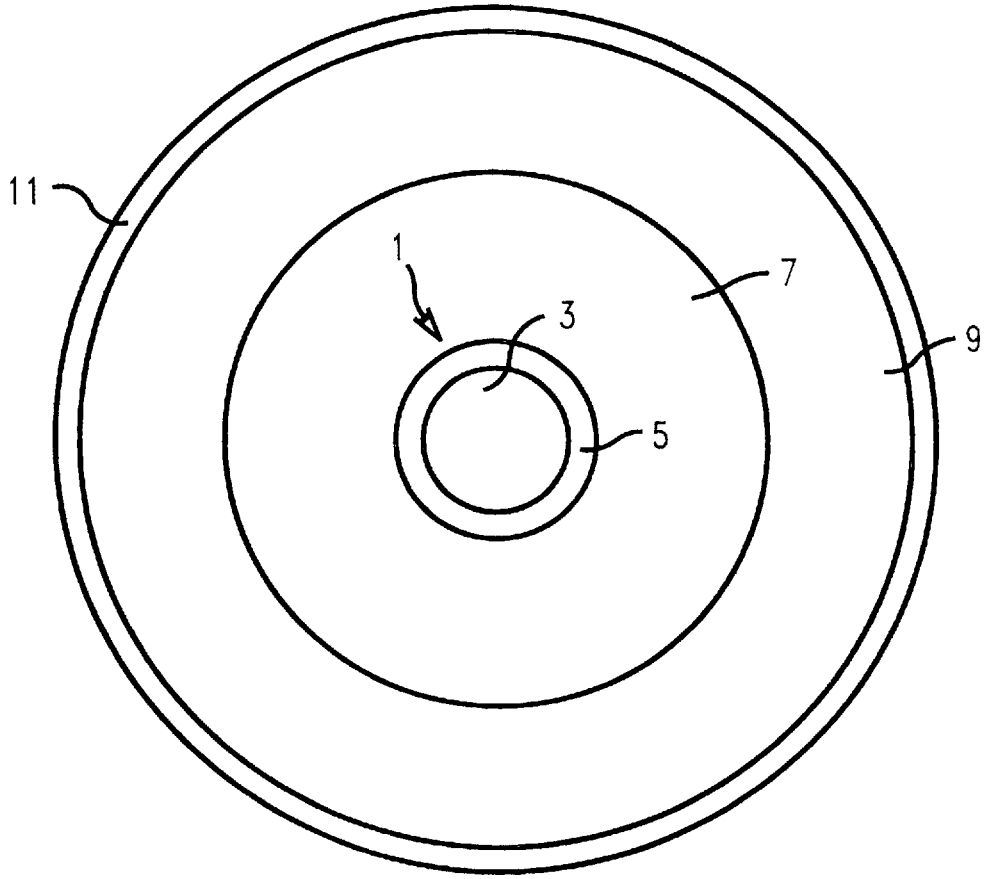
FIG. 1 is an end view of the coaxial wire connector for electronic device interconnection, in accordance with the present invention.

Referring now in greater detail to the drawings, reference will be made to FIGS. 1–3 of the drawings in which like numerals indicate like parts or features of the invention. Parts or features of the invention are not necessarily shown to scale in the drawings.

In the end view shown in FIG. 1, conductive core 1 includes a conventional copper wire 3 typically found in integrated circuit wire bond technology. The copper wire composition could include other elements such as cadmium or zirconium, conventionally used to create alloy compositions of copper to form a more resilient wire. The copper wire 3 may be 20 to 30 microns in diameter. The conductive core 1 also includes a gold plating layer 1 to 3 microns thick surrounding the copper wire 3.

Next, the conductive core 1 is surrounded by a layer of insulation/dielectric 7. This may be accomplished by repeated applications of a dielectric, such as, polyimide, Teflon or the like, followed by repeated oven bake cycles to cure the material. Continuous application and cure cycles are carried out until the appropriate thickness for dielectric layer 7 is obtained. Dielectric layer 7 may typically range from 15 to 25 microns.

Following the fabrication of dielectric layer 7, copper ground or shielding layer 9 is formed around the dielectric layer. Formation of the ground or shielding layer may be achieved by sensitizing the polyimide dielectric layer 7 with a solution of tin chloride then activating it with palladium chloride followed by electroless copper plating. The electroless plating process, being autocatalytic in nature, will continue to plate until the desired thickness of the shielding layer is obtained. Typically, 10 to 15 microns in thickness is sufficient for this purpose. As an alternative to complete electroless plating of the copper shielding layer 9, electrolytic plating could be used by first plating an electroless seed layer around polyimide dielectric layer 7 and then employing the electrolytic plating. Electrolytic plating would speed up copper deposition and allow more precise control of its thickness.

Although use of copper as the conductive shielding layer has been described, it is clear that other conductive material, such as nickel, could likewise be used. Likewise, although the use of polyimide and Teflon as the dielectric layer 7 has been described, it is clear that other dielectric materials, such as a polyester resin, could be used.

After formation of copper shielding layer 9, a layer of tin 11 is applied to the copper by the electroless or immersion (self limiting) plating processes or by the electroplating process, depending upon which process was used for the bulk of the copper layer, as described above. The purpose of tin layer 11 is to prevent the copper from oxidizing and to make the copper shielding layer more easily solderable.

A further extension of the coaxial wire connector structure of FIG. 1 includes the addition of a second dielectric layer surrounding the copper shielding layer 9. This second dielectric layer would be fabricated using the same materials and processes as was described above to fabricate dielectric layer 7, and would be fabricated to the same range of thickness. The purpose of the additional dielectric layer is to prevent, for example, inductive coupling between wires in those instances when it would be necessary for wire to run over or intersect other wire. This might occur, for example, in making connections on the top surface of high density chips.

Although the coaxial wire connector of the present invention could be used to connect any of a variety of electronic devices together, it is particularly useful for chip applications, such as, connecting chips to other chips or chips to substrates or circuit boards. The problem of wire electrical noise and cross talk is more severe in high density I/O chip applications. The problem of wire electrical noise and cross talk is further amplified for RF-type chip applications as, for example, RF applications using SiGe chips.

In accordance with the present invention, the coaxial wire connector is designed for connectability and low noise coupling in high density I/O and RF applications. This is in part a result of the fact that the coaxial wire connector can be accurately and minimally striped of shielding material by laser ablation to the pitch of the input/output pads in preparation for connection to electronic devices. In addition, effective connection to electronic devices is simply achieved by wire bonding the gold plated wire core to a signal pad and hot tip soldering the tin-plated copper shielding layer to the corresponding ground pad.

Figure 2A:
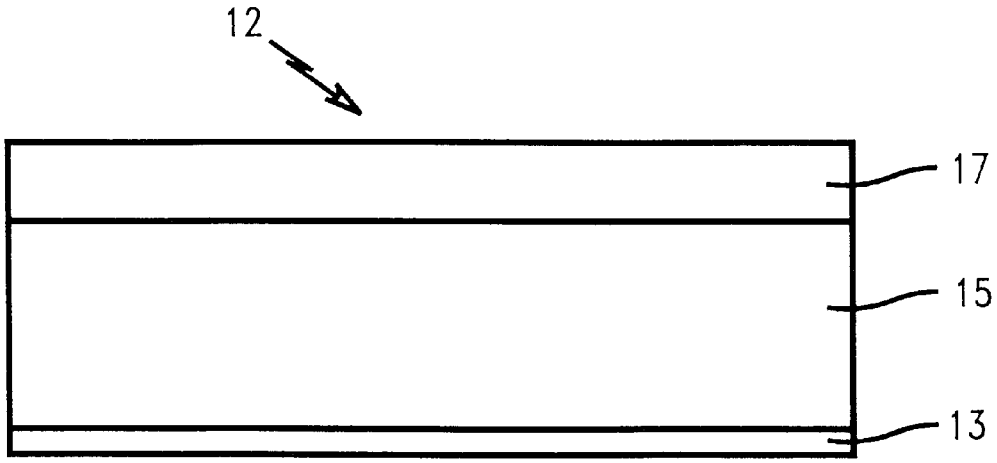
FIG. 2A is cross-sectional view of a signal pad on an electronic device for interconnection, in accordance with the present invention.

With reference to FIG. 2A, there is shown a cross-section of a standard semiconductor chip signal pad 12 used in the fabrication of fine pitch C4 technology. Layer 13 is made of chrome, typically around 0.1 microns thick and layer 15 is made of copper, typically 2–3 microns thick. The top layer 17 is made of gold, typically 0.5 to 1 microns thick.

Figure 2B:
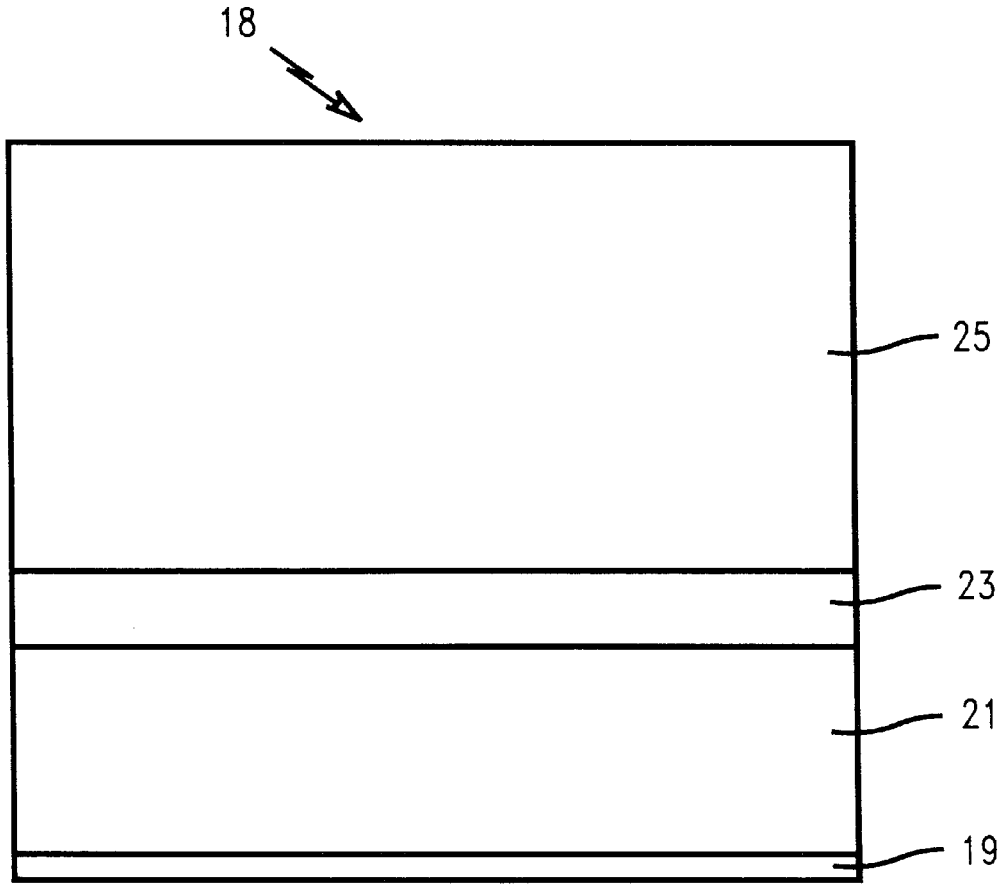
FIG. 2B is a cross-sectional view of a ground pad on an electronic device for interconnection, in accordance with the present invention.

With reference to FIG. 2B, there is shown a cross-section of a standard semiconductor chip ground pad 18 used in the fabrication of fine pitch C4 technology. Similar to that shown in FIG. 2A, layer 19 is made of chrome, layer 21 is made of copper and layer 23 is made of gold with the thicknesses of these layers being within the same range as described with respect to the corresponding layers in FIG. 2A. In addition to the layers of the signal pad of FIG. 1A, the ground pad of FIG. 2B has an electroplated tin/lead layer 25, typically 15 to 25 microns thick. This would typically be a low melting temperature solder alloy such as lead/tin eutectic or the like.

Figure 3:
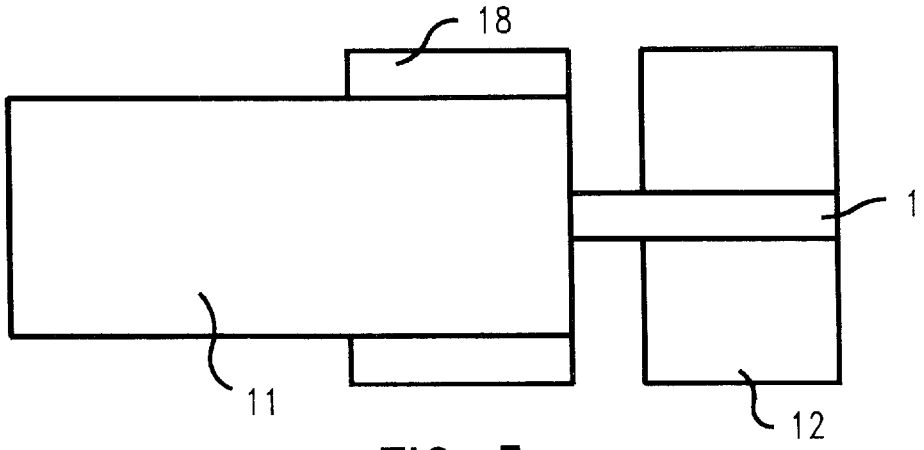
FIG. 3 is a top view of the manner of making attachment of the coaxial connector to signal and ground pads, in accordance with the present invention.

With reference to FIG. 3, there shown a top view of the manner in which the coaxial connector of the present invention is connected to the signal pad 12 and ground pad 18, shown respectively in FIGS. 2A and 2B. In accordance with further aspects of the present invention, the process used for attaching the coaxial wire connector to semiconductor chip signal and ground pads at one end and, for example, to laminate signal and ground pads at the other end, will now be described with reference to FIGS. 1 and 3.

The first step involves removing the tin-plated copper shielding layer 9 and dielectric layer 7, as shown in FIG. 1, to thereby expose conductive core 1 a length sufficient to accommodate the semiconductor chip pitch, as shown in FIG. 3. This is achieved by laser ablation through the respective layers to gold layer 5 which layer is plated to copper wire core 3. An Eximer laser works well for this process, acting to expose a clean gold-plated copper wire conductive core 1, as shown in FIG. 3. However, rather than an Eximer laser, a carbon dioxide or other laser that is fine-tuned to operate at less than 350 nanometers in wavelength could also be used.

Next, gold-plated copper wire conductive core 1 is wire bonded to signal pad 12, shown in FIG. 3. This can be done using conventional ultrasonic bonding. Tin-plated copper shielding layer 9, shown in FIG. 1, is then hot tip soldered to the tin/lead layer 25 of ground pad 18, as shown in FIG. 3. Similarly, the ablation, bonding and soldering steps are employed in like manner to connect the other end of the coaxial connector of FIG. 1 to signal and ground pads on a laminate, such as a substrate or board, or to another semiconductor chip.

As an alternative to laser ablation, micromechanical means, such as a wire stripper, could be employed to remove both the metal and insulating layers to expose the gold-plated copper wire core.

It will be understood from the foregoing description that various modifications and changes may be made in the preferred embodiment of the present invention without departing from its true spirit. It is intended that this description is for purposes of illustration only and should not be construed in a limiting sense. The scope of this invention should be limited only by the language of the following claims.

What is claimed is:

1. A coaxial connector for interconnecting high frequency electronic devices with minimal unshielded wire, comprising:

a conductive wire core 20 to 30 microns in diameter surrounded by a thin layer of gold for connection to a signal pad with said thin layer of gold surrounded by a layer of dielectric, and the surface of said layer of dielectric having formed thereon a conductive shielding layer coated with a thin layer of tin for connection to an adjacent ground pad, said conductive wire core surrounded by a thin layer of gold extending beyond said layer of dielectric having formed thereon a conductive shielding layer coated with a thin layer of tin a distance no greater than that required to connect to said signal pad and accommodate the high frequency electronic device signal to ground pad spacing.

2. The coaxial connector as set forth in claim 1 wherein said conductive wire core is copper.

3. The coaxial connector as set forth in claim 2 wherein said conductive shielding layer is copper.

4. The coaxial connector as set forth in claim 2 wherein said conductive shielding layer is nickel.

5. The coaxial connector as set forth in claim 3 wherein said layer of dielectric is polyimide.

6. The coaxial connector as set forth in claim 5 wherein said layer of gold is 1 to 3 microns thick, said layer of dielectric is 15 to 25 microns thick and said conductive shielding layer is 10–15 microns thick.

7. The coaxial connector as set forth in claim 1 wherein said conductive shielding layer is surrounded by a layer of dielectric.

8. The coaxial connector as set forth in claim 6 wherein said conductive copper wire core surrounded by said thin layer of gold is connected to the gold cap layer of a chrome/copper/gold signal pad and said conductive shielding layer coated with a thin layer of tin is connected to a tin-lead cap layer of a chrome/copper/gold tin-lead ground pad of an electronic device.

9. The coaxial connector as set forth in claim 8 wherein said electronic device is a semiconductor chip.

10. The coaxial connector as set forth in claim 9 wherein said semiconductor chip is SiGe.

11. A method of coaxially interconnecting high frequency electronic devices having closely spaced signal pads and ground pads with minimal unshielded wire, comprising:

removing a portion of a tin-plated conductive shielding layer contiguously surrounding a 20 to 30 micron diameter gold-plated conductive wire covered by dielectric to thereby expose a portion of said gold-plated conductive wire sufficient to accommodate the closely spaced signal and ground pad pitch and wire bond said conductive wire to one of said signal pads;

wire bonding said gold-plated conductive wire to one of said signal pads; and soldering said tin-plated conductive shielding layer to an adjacent one of said ground pads.

12. The method of claim 11 wherein the said conductive shielding layer of said tin-plated conductive shielding layer is copper.

13. The method of claim 11 wherein the said conductive wire of said gold-plated conductive wire is copper.

14. A method of interconnecting connecting high frequency electronic devices having a signal pad and an adjacent ground pad, comprising:

forming a coaxial connector having a conductive wire core surrounded by a thin layer of gold, with said thin layer of gold surrounded by a layer of dielectric and with the surface of said layer of dielectric having formed thereon a conductive shielding layer coated with a thin layer of tin;

laser ablating said conductive shielding layer and said layer of dielectric to expose a length of said conductive wire core surrounded by a thin layer of gold with said length sufficient to accommodate the spacing between said signal pad and said ground pad;

wire bonding said conductive wire core surrounded by a thin layer of gold to said signal pad; and hot tip soldering said conductive shielding layer coated with a thin layer of tin to said ground pad.

15. A method of coaxially interconnecting high frequency electronic devices having closely spaced signal pads and ground pads comprising:

laser ablating a portion of a tin-plated conductive shielding layer contiguously surrounding a gold-plated conductive wire covered by dielectric to thereby expose a portion of said gold-plated conductive wire sufficient to wire bond said conductive wire to one of said signal pads;

wire bonding said gold-plated conductive wire to one of said signal pads; and soldering said tin-plated conductive shielding layer to one of said ground pads.

* * * * *